US005131504A

United States Patent [19]

Yoo et al.

[11] Patent Number: 5,131,504

[45] Date of Patent: Jul. 21, 1992

[54] ELEVATOR NOISE MINIMIZER

[75] Inventors: Young S. Yoo, Avon; John K. Salmon, South Windsor, both of Conn.; Keith Worsley, Como West, Australia

[73] Assignee: Otis Elevator Company, Farmington, Conn.

[21] Appl. No.: 674,289

[22] Filed: Mar. 21, 1991

[51] Int. Cl.[5] ..... B66B 13/00

[52] U.S. Cl. ..... 187/56; 49/416

[58] Field of Search ..... 187/51, 56, 1 R, 98, 187/58; 49/415, 416

[56] References Cited

U.S. PATENT DOCUMENTS

| | | | |
|---|---|---|---|
| 2,218,068 | 10/1940 | Klein | 187/56 |
| 2,668,317 | 2/1954 | Le Bon, III | 49/415 |
| 3,420,002 | 1/1969 | Kondolf | 49/416 |
| 5,083,639 | 1/1992 | Kappeler | 187/51 |

FOREIGN PATENT DOCUMENTS

| | | | |
|---|---|---|---|
| 147348 | 12/1978 | Japan | 187/1 R |
| 57741 | 5/1979 | Japan | 187/51 |

*Primary Examiner*—Robert P. Olszewski
*Assistant Examiner*—Kenneth Noland
*Attorney, Agent, or Firm*—Lloyd D. Doigan

[57] ABSTRACT

A car door seal, comprising a brush, is utilized to seal the openings between a closed car door and an elevator car and to minimize backlash between the car doors and the car. By utilizing a brush, such uneven openings are effectively sealed because the brushes bend for narrower openings between the car door and the car. The brush also provides an effective damping and spring force between the door and the car. As a result, door rattle, caused by backlash and aerodynamically induced vibration loads during car travel, is minimized thereby minimizing vibration and noise within the interior of the car.

7 Claims, 2 Drawing Sheets

ELEVATOR NOISE MINIMIZER

TECHNICAL FIELD

This invention relates to elevators and more particularly to a device for minimizing the noise and vibration migrating to the interior of an elevator car.

BACKGROUND ART

Elevator cars have doors which enclose the interior of the car when the car travels along a hoistway. The doors, which translate across an opening, are supported at their upper periphery by rollers hung from a car lintel, and at their lower periphery by gibs guided by grooves within a car doorsill. When the doors close, there are some openings around the door edges.

Typically, the area of the openings can be minimized by using heavier gauge material and/or by requiring tighter manufacturing tolerances. However, heavier gauge material is more expensive and tighter tolerances may cause installation problems. Normal practice requires relatively looser tolerances to allow for manufacturing variations. As a result, the openings, which are larger than desirable, allow noise to migrate to the interior of the car.

Further, there is a certain amount of backlash between the lintel and the rollers and between the gibs and the doorsill. The backlash may allow the car doors to rattle as the car encounters aerodynamically induced vibration loads during car travel thereby increasing noise and vibration within the interior of the car.

DISCLOSURE OF THE INVENTION

It is an object of the invention to provide an elevator car having a minimum of noise therein.

It is a further object of the invention to minimize vibration within the elevator car.

According to the invention, a car door edge seal is utilized to seal the openings between a closed car door and an elevator car and to minimize backlash between the car doors and the car.

According to a feature of the invention, the edge seal comprises a brush. By utilizing a brush, uneven openings between the car and the car doors are effectively sealed because the brushes bend for narrower openings between the car and the car doors. The brush also provides an effective damping and spring force between the door and the car. As a result, door rattle, caused by backlash and aerodynamically induced vibration loads during car travel, is minimized thereby minimizing vibration and noise within the interior of the car.

These and other objects, features, and advantages of the present invention will become more apparent in light of the following detailed description of a best mode embodiment thereof, as illustrated in the accompanying drawing.

BEST MODE FOR CARRYING OUT THE INVENTION

Figure 1:
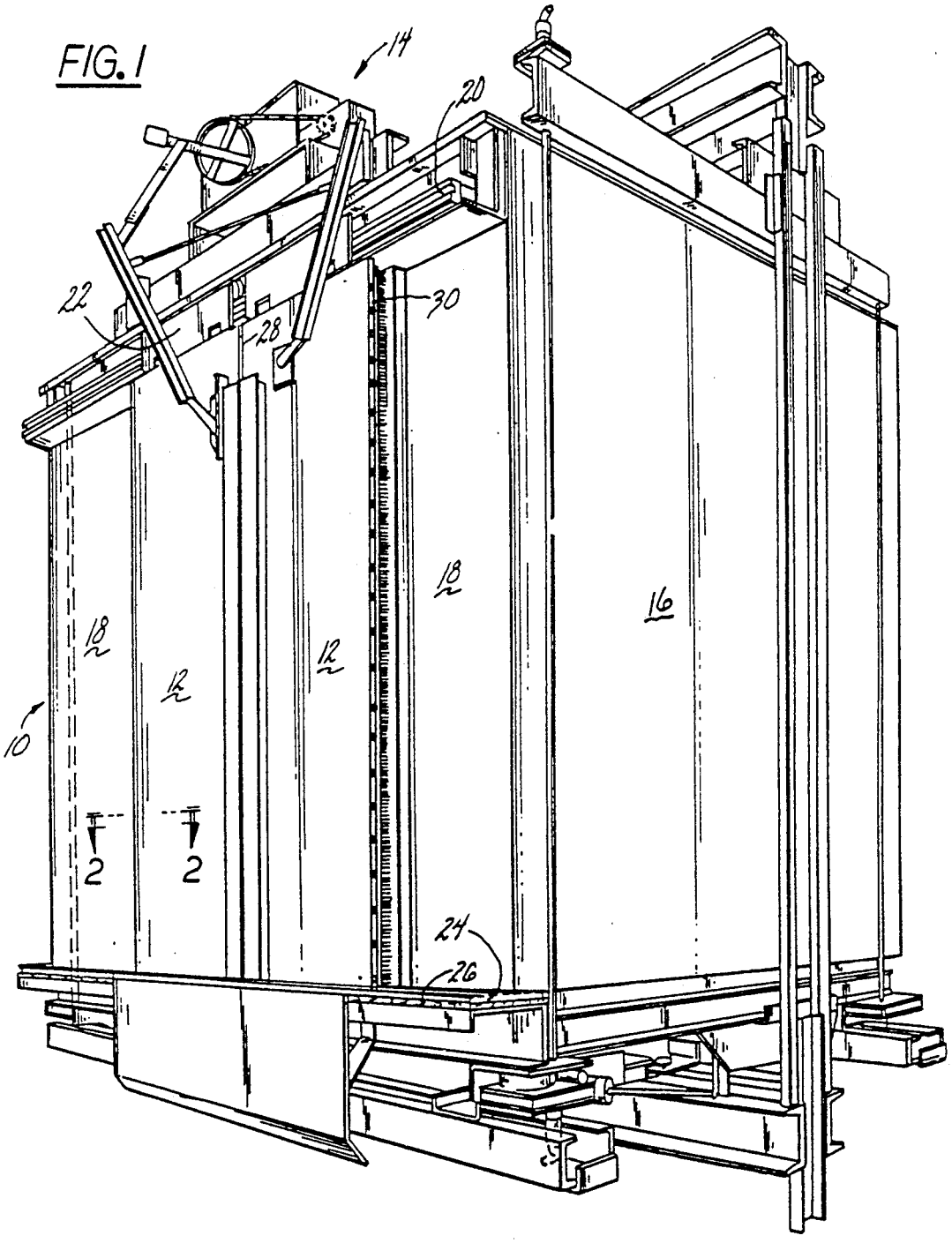
FIG. 1 shows an elevator car having an embodiment of the seal of the invention.

Referring to FIG. 1 an elevator car 10 is shown. the car consists of doors 12, a door operator 14, side panels 16, and front panels 18. As is known in the art each door hangs from a lintel 20 by means of a door hanger 22 and is guided at a lower portion thereof by gibs (not shown) disposed within a groove 24 of a doorsill 26. Each door has a leading edge 28, and a trailing edge 30.

Because of tolerances between each door 12 and front panels 1B, there are gaps (not shown) created between the front panels and the doors at the trailing edges 30 thereof. Noise and other extraneous sound leak into the car through these gaps. Further, because of backlash between the door hangers 22 and the lintel 20, and between the gibs and the doorsill 26, the doors rattle, creating additional noise, as the car encounters aerodynamically induced vibration during travel.

Figure 2:
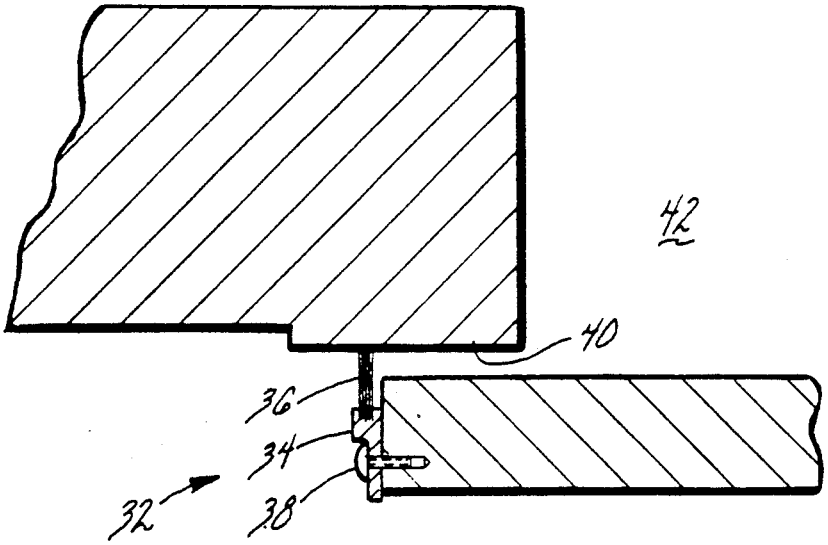
FIG. 2 is a view taken along the line 2—2 of FIG. 1.

Referring now to FIG. 2, a view taken along the line 2—2 is shown. A brush 32 is comprised of a metallic or plastic anchor 34 and a plurality of natural or artificial bristles 36 extending from the anchor, as is known in the art. The anchor is attached, by conventional means, such as screws 38, along a length of the trailing edge 30 of each door. The bristles extend from the trailing edge of each door towards the front panel 18 of the car.

Figure 3:
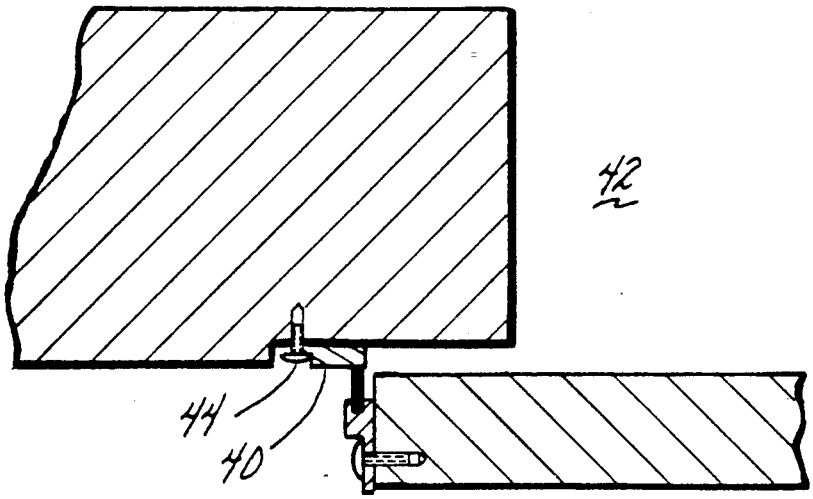
FIG. 3 shows a second embodiment along the lines of 2—2 in FIG. 1.

Each front panel 18 has a bead 40 at the edge of the door opening 42. The bead extends towards and mates with the brush 32. The bead may be integral with the front panel (see FIG. 2) or may be attached thereto (see FIG. 3) by means of screws 44 or the like. To prolong the life of the brush, the bead extends beyond the surface of the front panel so that the bristles 36 only contact the bead 40 over the length of travel of each door panel.

As will be appreciated by one of ordinary skill in the art, the brush forms a labyrinth seal to minimize the leakage of noise to the interior of the cab. The brush also provides an effective damping and spring force between the doors and the front panel. The damping and spring forces minimize backlash which causes the car doors to rattle as the car encounters aerodynamically induced vibration loads during car travel thereby minimizing noise and vibration within the interior of the car.

Although the invention has been shown and described with respect to a detail embodiment thereof, it will be understood by those skilled in the art that various changes in form and detail thereof may be made without departing from the spirit and scope of the invention. Particularly, one of ordinary skill in the art would understand that other types of seals, such as a rubber seal, might be utilized in such an application, that the bead may be chamfered to minimize wear on the brushes as they engage and disengage the bead, that a seal may also be disposed at the upper edges of the door, and that the seal may be disposed upon the exterior surface of the car and the bead may be disposed upon the door edges.

We claim:

1. Apparatus for minimizing noise and vibration in an elevator car, said car having an exterior, an interior, and a door, said door acting as a barrier to said interior and having a length of travel, said apparatus comprising:

unitary means for minimizing infiltration of noise through gaps between said door and said exterior and for minimizing backlash between said door and said exterior, said means extending from one of said door or said exterior of said car toward an other of said door or said exterior of said car, said unitary means has a spring force to effect a minimizing of the backlash between the door and the exterior and which extends along the door to substantially close a vertical gap between the door and the exterior to minimize infiltration of noise.

2. The apparatus of claim 1 wherein said unitary means comprises:

an elongated brush extending along a dimension of said door, said brush having a spring force for minimizing backlash between said door and said exterior.

3. The apparatus of claim 2 further comprising:

means extending from said other of said door or said exterior for engaging said unitary means such that said unitary means engages only said extending means over the length of travel of said door to minimize wear of said means.

4. The apparatus of claim 3 wherein said extending means comprises:

a bead extending from said other of said door or said exterior.

5. The apparatus of claim 1 further comprising:

means extending from said other of said door or said exterior for engaging said unitary means such that said unitary means engages only said extending means over the length of travel of said door to minimize wear of said unitary means.

6. The apparatus of claim 5 wherein said second means comprises:

a bead extending from said other of said door or said exterior.

7. The apparatus of claim 6 wherein said first means comprises:

an elongated brush extending along a dimension of said door, said brush having a spring force for minimizing backlash between said door and said exterior.

* * * * *